US006759836B1

(12) United States Patent
Black, Jr.

(10) Patent No.: US 6,759,836 B1
(45) Date of Patent: Jul. 6, 2004

(54) LOW DROP-OUT REGULATOR

(75) Inventor: Robert G. Black, Jr., Oro Valley, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 2 days.

(21) Appl. No.: 10/263,053

(22) Filed: Oct. 1, 2002

(51) Int. Cl.[7] ..... G05F 1/44
(52) U.S. Cl. ..... 323/288; 323/284; 323/901
(58) Field of Search ..... 323/288, 284, 323/901, 283

(56) References Cited

U.S. PATENT DOCUMENTS 5,973,944 A * 10/1999 Nork ..... 363/60
6,603,292 B1 * 8/2003 Schouten et al. ..... 323/277

* cited by examiner

*Primary Examiner*—Shawn Riley
(74) *Attorney, Agent, or Firm*—Merchant & Gould P.C.; Joshua W. Korver

(57) ABSTRACT

A first capacitive circuit is coupled to an output of a low drop-out (LDO) regulator. A second capacitive circuit is selectively coupled to a power supply signal circuit and arranged to store charge when the LDO regulator is deactivated. When the LDO regulator is activated, a portion of the charge on the second capacitive circuit is transferred to the first capacitive circuit. The LDO regulator provides an output when the charge associated with the first capacitive circuit reaches a predetermined level. The power-on time of the LDO regulator depends on the time required to increase the charges of the first capacitance circuit to the predetermined level from a level associated with the transferred charge from the second capacitive circuit. Also, the presence of the first capacitive circuit prevents noise associated with the power supply from being reflected at the output of the LDO regulator.

18 Claims, 5 Drawing Sheets

LOW DROP-OUT REGULATOR

FIELD OF THE INVENTION

The present invention is generally related to voltage regulators. More particularly, the present invention is related to a circuit for improving power-on speed and power supply rejection ratio (PSRR) characteristics for a low drop out voltage (LDO) regulator.

BACKGROUND OF THE INVENTION

Voltage regulators are often used to provide a relatively constant voltage source to other electronic circuits. Some regulators are limited in their effectiveness in a particular application. For example, some regulators have a high "drop-out" voltage. A "drop-out" voltage is the minimum voltage difference between the input voltage and the output voltage that is necessary to maintain proper regulation. Large drop-out voltages result in wasted power, and raise the minimum power supply requirements for maintaining regulation.

A low-drop-out regulator (hereinafter referred to as an "LDO regulator") is useful in applications where it is desired to maintain a regulated voltage that is sufficiently close to the input voltage. For example, LDO regulators are useful in battery-powered applications where the power supply voltage is exceedingly low.

A typical LDO regulator (500) is shown in FIG. 5. The LDO regulator (500) includes a PMOS transistor (MP50), a first resistor (R50), a second resistor (R51), and a voltage control block (510). The PMOS transistor (MP50) has a drain that is connected to an output terminal (VREG), a gate that is connected to node N50, and a source that is connected to an input voltage (VIN). The first resistor (R51) is series connected between the output terminal (VREG) and node N51. The second resistor (R52) is series connected between node N51 and a circuit ground (GND). The voltage control block (510) has three input terminals (VIN, VREF, SENSE) and an output terminal (PCTL). In the voltage control block (510), the first input terminal (VIN) is connected to the input voltage (VIN), the second input terminal (VREF) is connected to a reference voltage (VREF), and the third input terminal (SENSE) is connected to node N51. The output terminal (PCTL) of the voltage control block (510) is connected to node N50.

A load (ZL) is connected to the output terminal (VREG) of the LDO regulator (500). The LDO regulator (500) controls the gate of the PMOS transistor (MP50) to ensure that regulation of the output voltage (VREG) is maintained. The voltage control block (510) monitors the SENSE input terminal and controls the gate of the PMOS transistor (MP50) through the PCTL output terminal. Resistors R51 and R52 form a resistor divider that produces a signal that is related to the regulated output voltage (VREG). When the SENSE input terminal and the reference signal (VREF) are substantially the same, the LDO is properly maintaining regulation of the output voltage to the load (ZL).

SUMMARY OF THE INVENTION

Briefly stated, the present invention is arranged to provide an enhanced power-on speed for a low drop-out (LDO) voltage regulator while improving power supply rejection ratio (PSRR) performance. A first capacitive circuit is coupled to the output of the LDO regulator. A second capacitive is selectively coupled to a power supply signal circuit and arranged to store charge when the LDO regulator is deactivated. When the LDO regulator is activated, a portion of the charge on the second capacitive circuit is transferred to the first capacitive circuit. The configuration decreases the power-on time of the LDO regulator, and provides for improved PSRR characteristics.

In accordance with the present invention, an apparatus for providing improved power-on speed and power supply rejection ratio (PSRR) characteristics for a low drop-out (LDO) voltage regulator includes a low drop-out (LDO) voltage regulator that is configured to provide an output voltage to an output when activated. A first capacitive circuit is coupled to the output of the low drop-out (LDO) voltage regulator. A second capacitive circuit is selectively coupled to a power supply during a first cycle and selectively coupled to the first capacitive circuit during a second cycle. The first cycle corresponds to when the low drop-out (LDO) voltage regulator is deactivated, and the second cycle corresponds to when the low drop-out (LDO) voltage regulator is activated.

In accordance with another aspect of the invention, a first switch circuit is coupled between the second capacitive circuit and the power supply. A second switch circuit is coupled between the first capacitive circuit and the second capacitive circuit. The first switch circuit is closed and the second switch circuit is open during the first cycle. The first switch circuit is open and the second switch circuit is closed during the second cycle. A first resistor is coupled between the first switch circuit and the power supply. Current is provided to the second capacitive circuit across the first resistor when the first switch circuit is closed. The first switch circuit is responsive to a first control signal and the second switch circuit is responsive to a second control signal.

The invention may also be implemented as methods that perform substantially the same functionality as the embodiments of the invention discussed above and below.

A more complete appreciation of the present invention and its improvements can be obtained by reference to the accompanying drawings, which are briefly summarized below, to the following detail description of presently preferred embodiments of the invention, and to the appended claims.

DETAILED DESCRIPTION OF THE PREFERRED EMBODIMENT

Throughout the specification, and in the claims, the term "connected" means a direct electrical connection between the things that are connected, without any intermediate devices. The term "coupled" means either a direct electrical connection between the things that are connected, or an indirect connection through one or more passive or active intermediary devices. The term "circuit" means either a single component or a multiplicity of components, either active or passive, that are coupled together to provide a desired function.

The present invention is generally related to low drop-out voltage regulators (LDO regulators). LDO regulators are used quite frequently in Integrated Circuit (IC) design applications. A disadvantage of most designs involves the inability of the LDO electronics to prevent noise on the power supply from affecting the circuits attached to the output of the LDO regulator. Most IC designs have output devices that do not have sufficient output impedance to sustain minimum Power Supply Rejection Ratios (PSRR) for certain applications. Another limiting factor limiting the PSRR is the low input voltage that is applied to the LDO electronics.

Often, the reason for these shortcomings focuses on the Loop Gain and Bandwidth of the system. In order to provide excellent PSRR performance, the output of the LDO regulator drives a low impedance relative to the output impedance of the pass device in the LDO regulator. A low impedance is generally provided by coupling a capacitor to the output of the LDO regulator. The capacitor has a very low equivalent series resistance (ESR) and an AC impedance that is low relative to the pass element impedance at the frequency of operation. The output impedance of the LDO regulator decreases as the power supply noise is increased in frequency. Accordingly, LDO regulator circuits are often designed with a capacitor at the output to improve the PSRR and prevent the effect of noise on the power supply. However, tradeoffs are often made to improve PSRR performance, such as a reduced power-on time for the LDO regulator.

The present invention is arranged to provide a decreased power-on time for an LDO regulator, while improving PSRR performance. A first capacitive circuit is coupled to the output of the LDO regulator. A second capacitive circuit is selectively coupled to the power supply. When the LDO regulator is activated, a portion of the charge on the second capacitive circuit is transferred to the first capacitive circuit. The power-on time of the LDO regulator is decreased by transferring the charge from the second capacitive circuit to the first capacitive circuit. Also, the circuit provides for improved PSRR characteristics by including a capacitor at the output of the LDO regulator. In addition, ringing is minimized by initializing the output voltage to a higher voltage when the LDO is activated. The number of external components to the IC are also minimized.

Figure 1:
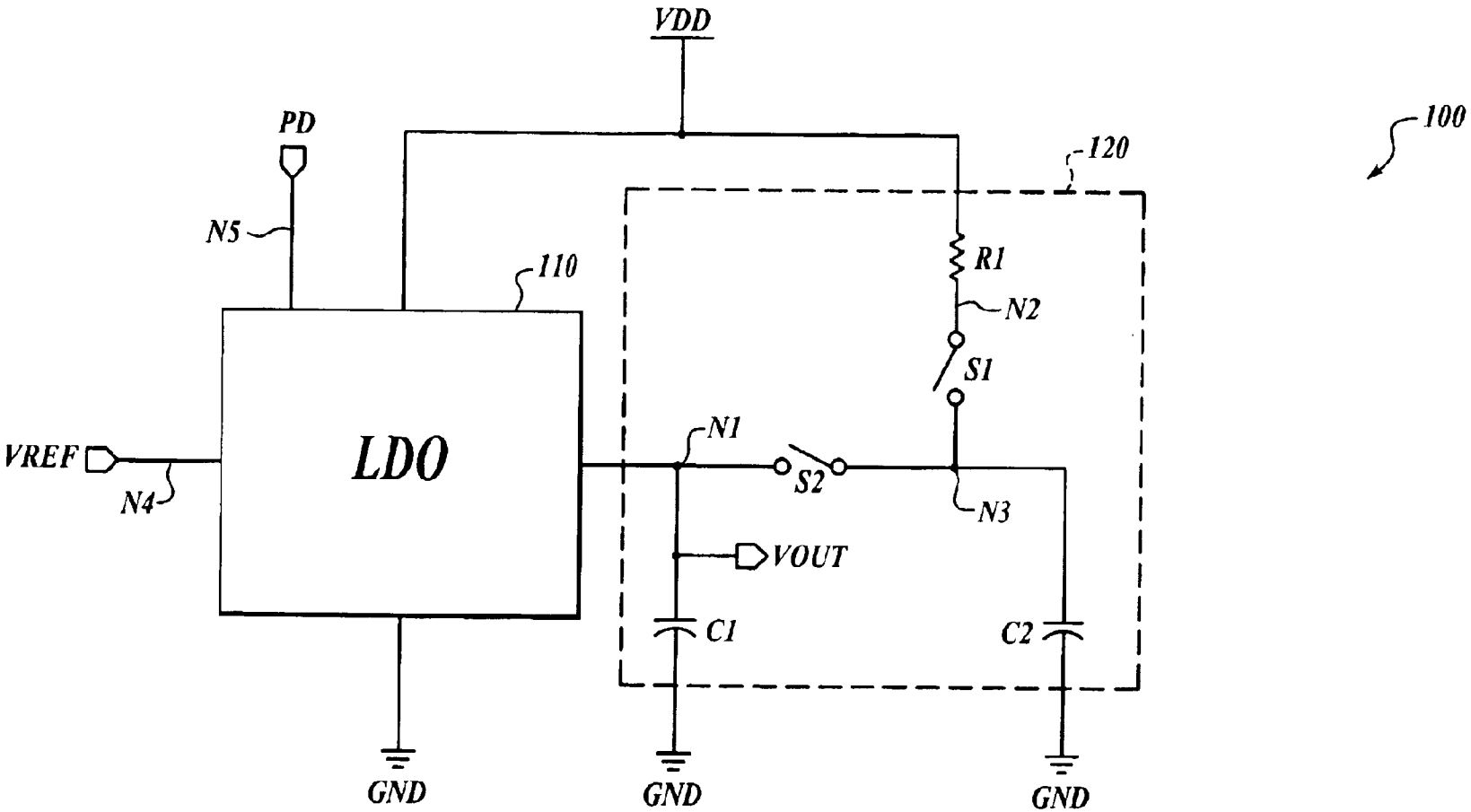
FIG. 1 is a schematic diagram of a regulator circuit arranged to provide enhanced power-on speed and improved PSRR to an LDO regulator.

FIG. 1 is a schematic diagram of a regulator circuit (100) arranged to provide enhanced power-on speed and improved PSRR to an LDO regulator. Regulator circuit 100 includes LDO regulator 110 and switched capacitor circuit 120. Switched capacitor circuit 120 includes a resistor (R1), two capacitive circuits (C1, C2), and two switch circuits (S1, S2).

LDO regulator 110 is coupled to a power supply (VDD), a circuit ground (GND), node N1, node N4, and node N5. Resistor R1 is coupled between VDD and node N2. Capacitive circuit C1 is coupled between node N1 and GND. Capacitive circuit C2 is coupled between node N3 and GND. Switch circuit S1 is coupled between node N2 and node N3. Switch circuit S2 is coupled between node N1 and node N3. In one embodiment, resistor R1, capacitive circuits C1 and C2, and switch circuits S1 and S2 are integrated into LDO regulator 110.

Circuit 100 is arranged to provide an output voltage (VOUT) at node N1 when LDO regulator 110 is activated. LDO regulator 110 is deactivated during a first cycle by powerdown signal (PD). Accordingly, LDO regulator 110 is prevented from generating an output voltage (VOUT). Switch circuit S1 is closed and switch circuit S2 is open during the first cycle. With switch circuit S1 closed, capacitive circuit C2 is charged by the power supply (VDD).

During a second cycle, LDO regulator 110 is activated. When LDO regulator 110 is activated, switch circuit S1 opens and switch circuit S2 closes. A portion of the charge on capacitive circuit C2 is conducted through switch circuit S2 charging capacitive circuit C1. Assuming the initial charge on capacitive circuit C1 is zero, capacitive circuit C1 charges to a voltage level that is dependent upon the relative values of capacitive circuit C1 and capacitive circuit C2. The charge rate or power-on time can be set by designing switch circuit S2 to a resistive value that limits the charging current conducted across switch circuit S2. Switch circuits S1 and S2 are controlled by control signals that are produced by control logic as shown in FIG. 2.

Figure 2:
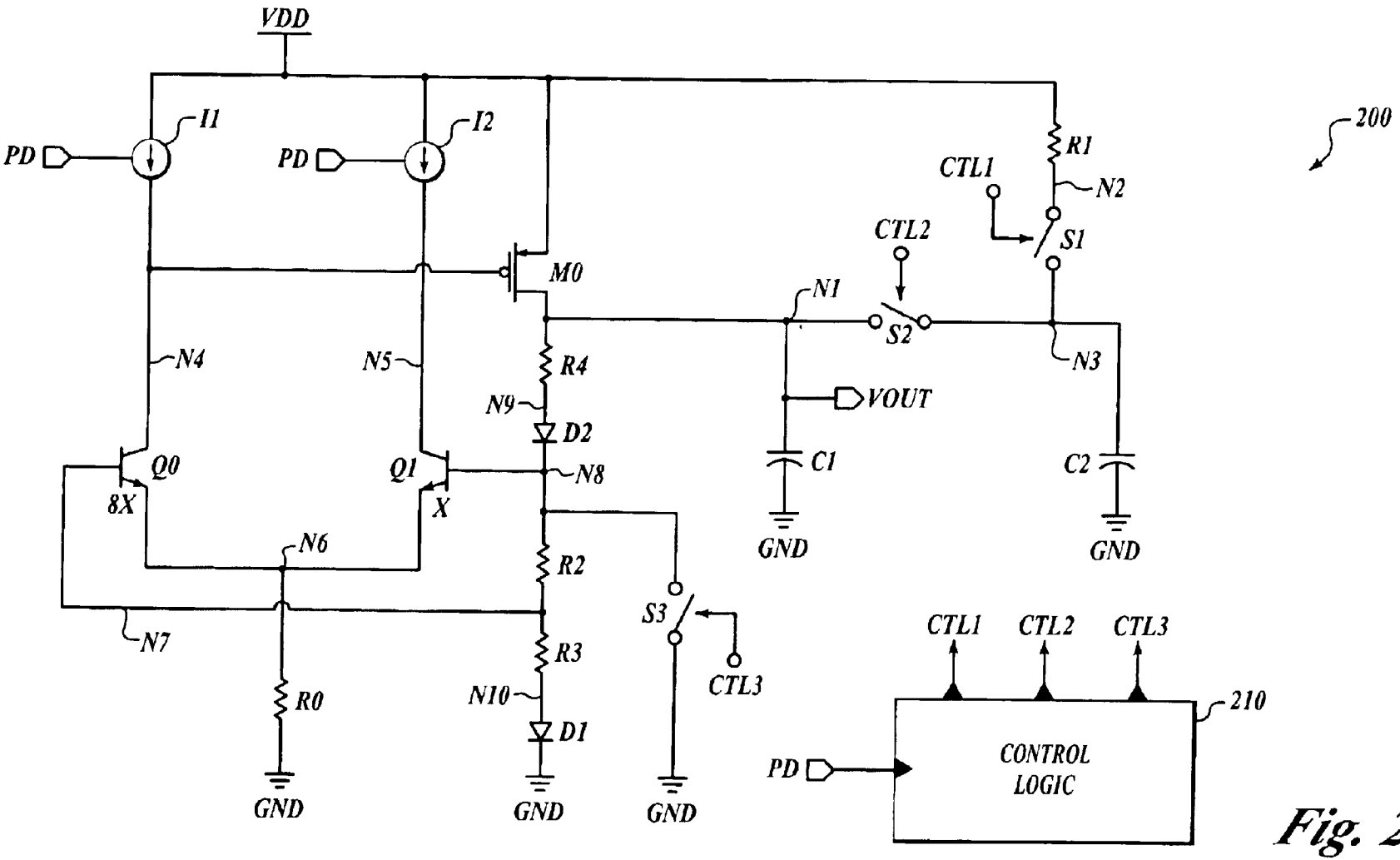
FIG. 2 is another schematic diagram of an exemplary LDO regulator with enhanced power-on speed and improved PSRR.

FIG. 2 is a schematic diagram of an exemplary LDO regulator (200) with enhanced power-on speed and improved PSRR. LDO regulator 200 includes five resistors (R0–R4), two diode circuits (D1, D2), three transistors (Q0, Q1, M0), two current sources (I1, I2), two capacitive circuits (C1, C2), three switch circuits (S1, S2, S3), and control logic 210. Similar components and connections from FIG. 1 are labeled identically in FIG. 2.

Resistor R0 is coupled between node N6 and a circuit ground (GND). Resistor R1 is coupled between a power supply (VDD) and node N2. Resistor R2 is coupled between node N7 and node N8. Resistor R3 is coupled between node N7 and node N10. Resistor R4 is coupled between node N1 and node N9. Diode circuit D1 is directionally coupled between node N10 and GND. Diode circuit D2 is directionally coupled between node N9 and N8. Transistor Q0 includes a collector that is coupled to node N4, an emitter that is coupled to node N6, and a base that is coupled to node N7. Transistor Q1 includes a collector that is coupled to node N5, an emitter that is coupled to node N6, and a base that is coupled to node N8. Transistor M0 includes a source that is coupled to the power supply (VDD), a drain that is coupled to node N1, and a gate that is coupled to node N4. Current source I1 is coupled between VDD and node N4. Current source I2 is coupled between VDD and node N5. Capacitive circuit C1 is coupled between node N1 and GND. Capacitive circuit C2 is coupled between node N3 and GND. Switch circuit S1 is coupled between node N2 and node N3. Switch circuit S2 is coupled between node N1 and node N3. Switch circuit S3 is coupled between node N8 and GND.

Control logic 210 produces three control signals (CTL1, CTL2, CTL3) in response to a powerdown signal (PD). Switch circuit S1 is responsive to control signal CTL1. Switch circuit S2 is responsive to control signal CTL2. Switch circuit S3 is responsive to control signal CTL3. In one embodiment, the control signals (CTL1, CTL2, CTL3) are generated such that they are "non-overlapping" signals. Non-overlapping refers to the transitions of each control signal occurring at different intervals of time.

LDO regulator 200 operates similarly to the regulator circuit (100) shown in FIG. 1. LDO regulator 200 is arranged to provide an output voltage (VOUT) at node N1 when active. LDO regulator 200 is powered down when the powerdown signal (PD) deactivates current sources I1 and I2. When LDO regulator 200 is powered down, switch circuit S1 is closed, switch circuit S2 is open, and switch circuit S3 is closed. Since LDO regulator 200 is deactivated, LDO regulator 200 is prevented from generating the output voltage (VOUT). At the same time, capacitive circuit C2 is charged by the power supply signal (VDD) with switch circuit S1 closed.

LDO regulator 200 is activated when current sources I1 and I2 are activated by powerdown signal (PD). When LDO regulator 200 is activated, switch circuit S1 opens, switch circuit S2 closes, and switch circuit S3 is open. A portion of the charge from capacitive circuit C2 is transferred to charge capacitive circuit C1. As previously stated, capacitive circuit C1 charges to a voltage level that is dependent upon the relative values of capacitive circuit C1 and capacitive circuit C2. The charge rate or power-on time may be set by designing switch circuit S2 to a resistive value that limits the charging conducted through switch circuit S2. Switch circuits S1 and S2 are controlled by control signals CTL1 and CTL2 produced by control logic 210. If control signals CTL1 and CTL2 are non-overlapping signals, switch circuits S1 and S2 are prevented from being either open or closed at the same time.

In one embodiment, capacitive circuit C1 is chosen to be 0.1 of capacitive circuit C2 (e.g., C1=0.1C2). The relative capacitance of capacitive circuit C1 to capacitive circuit C2 allows capacitive circuit C1 to be charged to approximately 0.9 VDD, or 0.9 of the power supply signal.

Resistors R0, R2, R3, Diodes D1 and D2, and transistors Q2 and Q3 provide the reference and temperature compensation for the output voltage (VOUT) of LDO regulator 200. The resistors and diode multiplier are adjusted to give the desired potential and temperature variation required for the output voltage (VOUT) of LDO regulator 200.

In one embodiment, LDO regulator 200 operates as an LDO bandgap reference regulator. The emitter area for transistor Q0 is eight times (8×) the emitter area of transistor Q1 (×). The currents provided by current source I1 and current source I2 are substantially equal. The difference in emitter areas generates a potential difference between the base-emitter voltages (Vbe) of transistors Q0 and Q1. The voltage difference (ΔVbe) between base-emitter voltages of transistors Q0 and Q1 is reflected across resistor R2. The voltage across resistor R2 is proportional to absolute temperature. Resistor R3 and diode circuit D1 are used to provide a zero temperature coefficient at the output voltage (VOUT) at a nominal temperature. Resistor R4 and diode circuit D2 provide adjustment to the potential of the output voltage (VOUT). The resistor ratios of resistors R2, R3, and R4, and the ratios of diode circuits D1 and D2, are adjusted to optimize the temperature performance of LDO regulator 200. Switch circuit S3, represents turn on/turn off circuitry of LDO regulator 200, and is controlled by control logic (not shown). Activation-of current sources I1 and I2 is similarly controlled by control logic (not shown). The pre-charging of capacitance circuit C2 serves to bootstrap, or lower the power-on transient of transistor M0. Transistor M0 is usually a large transistor to provide the low drop-out for LDO regulator 200. A parasitic gate capacitance of transistor M0 is increases as its size increases. The power-on time of transistor M0 increases as the parasitic capacitance increases since the gate of transistor M0 is pulled down to activate transistor M0. The current available from node N1 is increased in response to charge being transferred from capacitive circuit C2 to capacitive circuit C1 when LDO regulator 200 is activated. Accordingly, as transistor M0 is activated, the current on node N1 temporarily supplies power to regulation circuitry (e.g., resistor R4, diode circuit D2, etc . . . ) of LDO regulator 200. The level of current increase required to acitivate transistor M0 is therefore decreased, further decreasing the power-on time of LDO regulator 200.

LDO regulator 200 also reduces the number of components external to the IC. Often, external inductors and capacitors are used to filter the power supply signal and improve PSRR performance. The present invention minimizes the need for the external filtering circuitry by providing improved PSRR performance substantially internal to the IC, with only capacitive circuits C1 and C2 as external components.

In another embodiment, when the PSRR requirements for the circuit are lighter, capacitive circuit C1 may be removed, such that only capacitive circuit C2 is used with the switch circuit S1 and S2.

Figure 3:
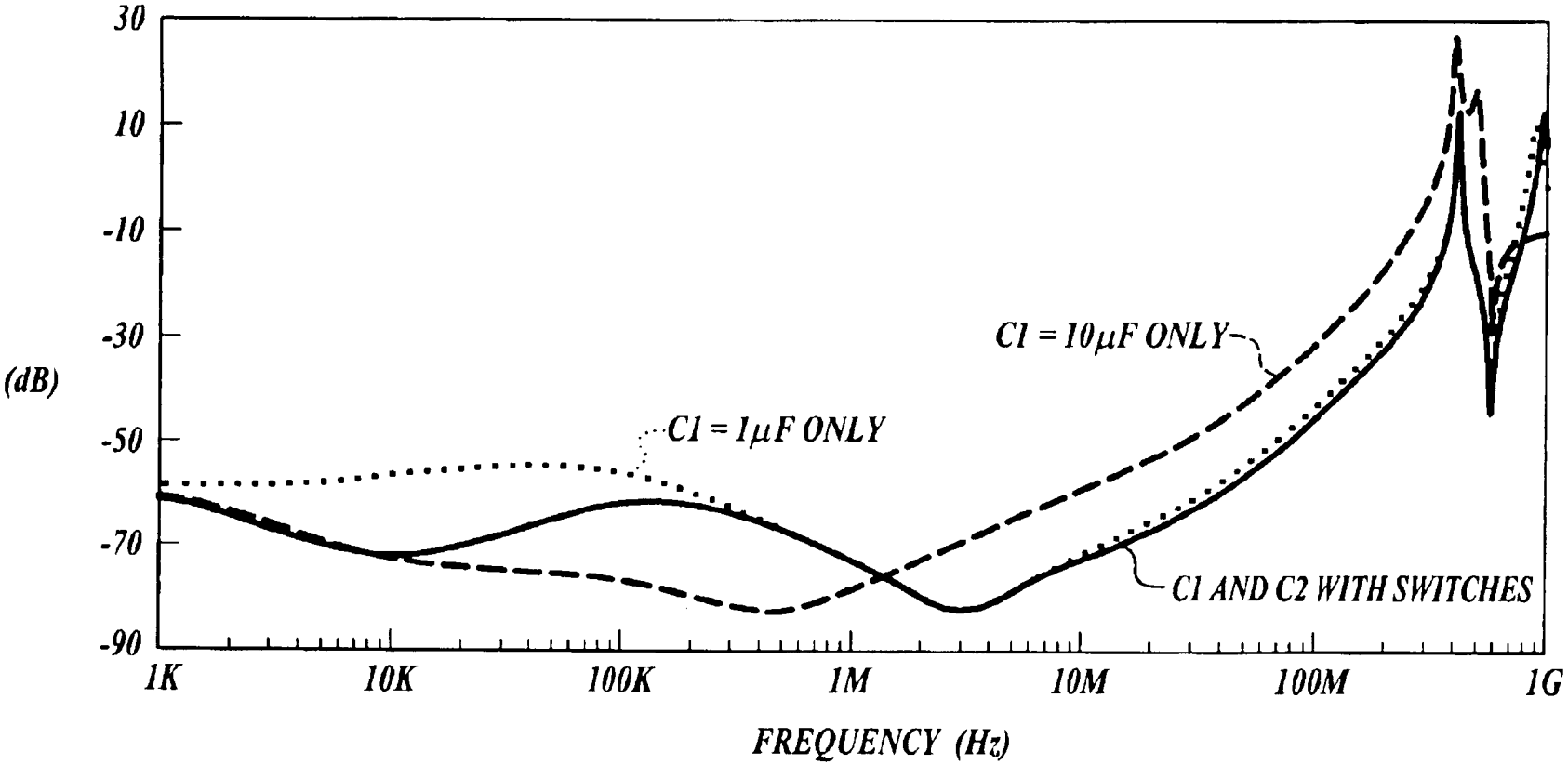
FIG. 3 is a graph of exemplary PSRR characteristics for different capacitor configurations for the exemplary LDO regulator shown in FIG. 2.

FIG. 3 is a graph of exemplary PSRR characteristics for different capacitor configurations for the LDO regulator (200) shown in FIG. 2. The graph shows three exemplary measurements of PSRR for three different configurations of LDO regulator 200. The PSRR is measured in decibels (dB) over a range of frequencies (1 kHz–1 GHz). The lower the decibels, the better the PSRR.

A first measurement (labeled as "C1 and C2 with Switches") corresponds to using the configuration as shown in FIG. 2 where capacitive circuit C1 is a 1 μF capacitor and capacitive circuit C2 is a 10 μF capacitor. A second measurement (labeled as "C1=1 μF Only") corresponds to removing capacitive circuit C2, switch circuits S1 and S2, and resistor R1 from LDO regulator 200. Accordingly, the load of LDO regulator 200 consists of capacitive circuit C1 only, where capacitive circuit C1 is a 1 μF capacitor. A third measurement (labeled as "C1=10 μF Only") corresponds to removing capacitive circuit C2, switch circuits S1 and S2, and resistor R1 from LDO regulator 200 where capacitive circuit C1 is a 10 μF capacitor.

As may be seen, when the configuration as shown in FIG. 2 is used, the PSRR is improved by approximately 15 dB at 10 kHz over the single 1 μF capacitor at the same frequency. Also, the PSRR is improved by approximately 12 db at 10 MHz over the single 10 μF capacitor. In the embodiment of FIG. 2, the PSRR generally decreases as frequency is increased. The PSRR of the configuration shown in FIG. 2 may be improved by decreasing the switch resistance of switch circuit S2 at the cost of higher transient current through switch circuit S2.

Figure 4:
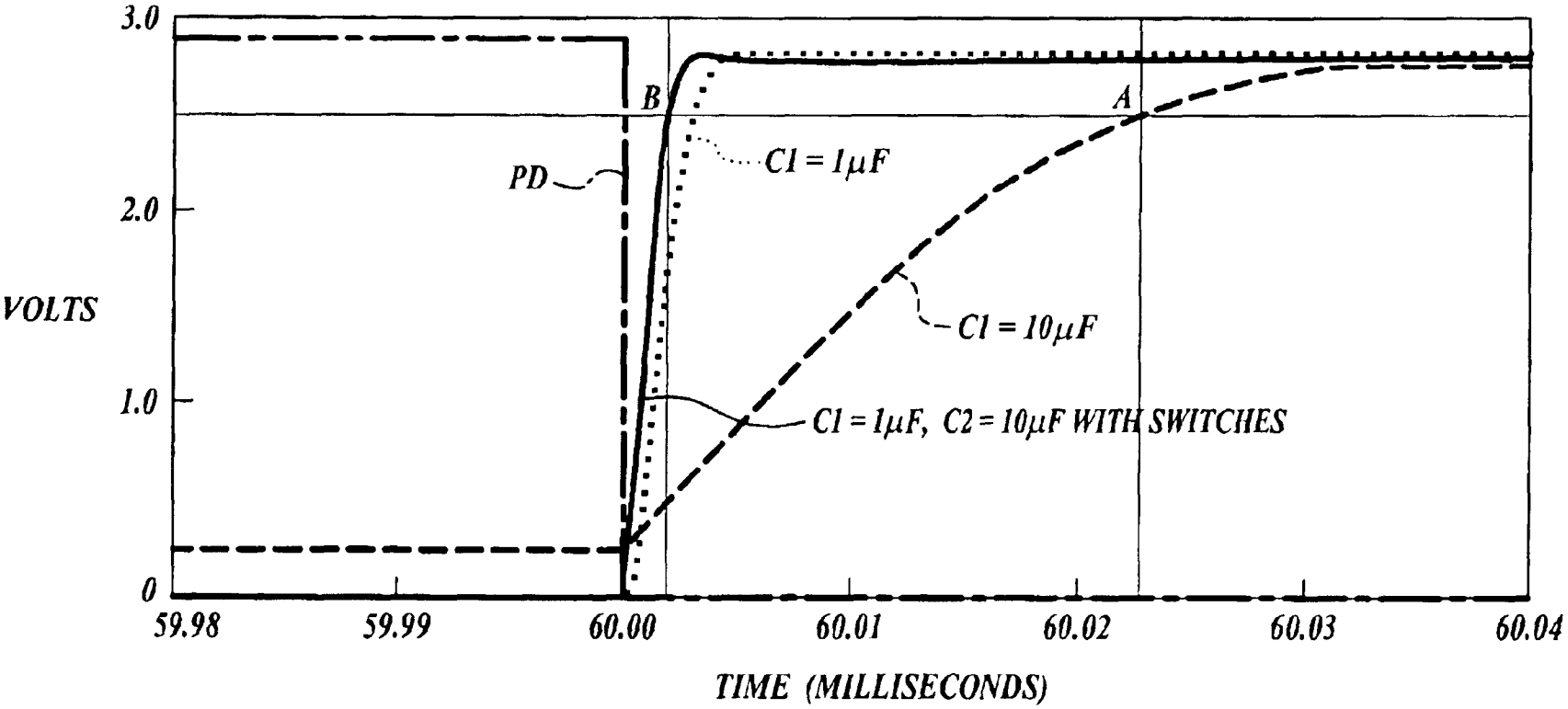
FIG. 4 is a graph of exemplary transient responses for different capacitor configurations for the exemplary LDO regulator shown in FIG. 2, in accordance with the present invention.

FIG. 4 is a graph of exemplary transient responses for different capacitor configurations for the LDO regulator shown in FIG. 2. Similar to FIG. 3, the graph shows three exemplary measurements of transient time for three different configurations of LDO regulator 200. The transient time, the time for the output voltage (VOUT) of LDO regulator 200 to transition from a voltage of 0V to a steady-state voltage (e.g., 2.9V), is measured in seconds (s) from the time the powerdown signal (PD) transitions. The less time taken for transition, the better the transient time, or power-on time.

A first measurement (labeled as "C1=1 μF, C2=10 μF with Switches") corresponds to using the configuration as shown in FIG. 2 where capacitive circuit C1 is a 1 μF capacitor and capacitive circuit C2 is a 10 μF capacitor. A second measurement (labeled as "C1=1 μF") corresponds to removing capacitive circuit C2, switch circuits S1 and S2, and resistor R1 from LDO regulator 200. Accordingly, the load of LDO regulator 200 consists of capacitive circuit C1 only, where capacitive circuit C1 is a 1 μF capacitor. A third measurement (labeled as "C1=10 μF") corresponds to removing capacitive circuit C2, switch circuits S1 and S2, and resistor R1 from LDO regulator 200 where capacitive circuit C1 is a 10 $\mu$F capacitor.

As may be seen, when the configuration as shown in FIG. 2 is used, the transient time for LDO regulator 200 is better than both configurations where a single capacitor is used. The LDO regulator turn on time is decreased by 50% or more with switched capacitance circuits.

Figure 5:
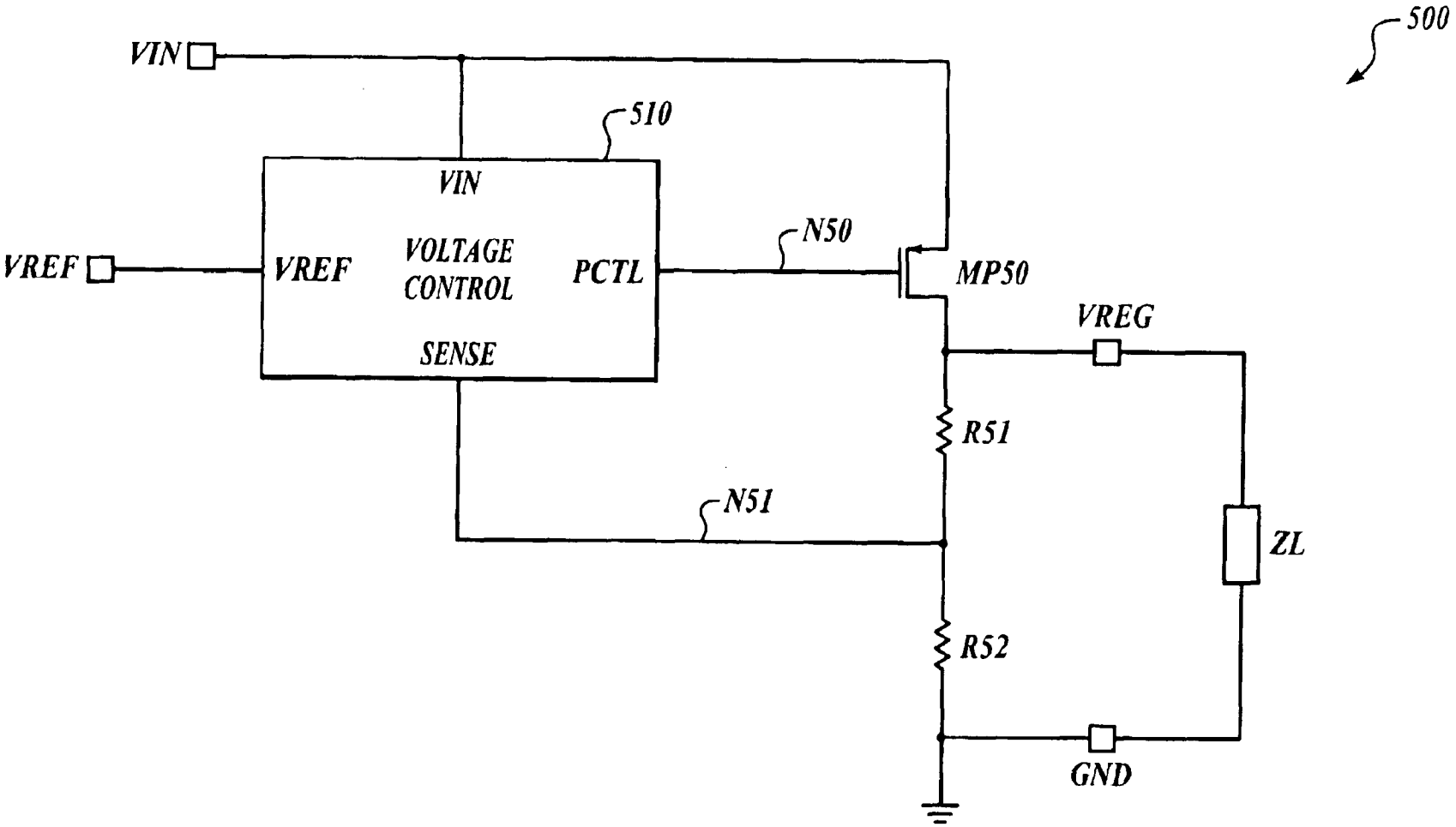
Fig. 5. (PRIOR ART)
FIG. 5 is a schematic diagram of a conventional low drop-out voltage regulator.

In light of the above description, it is understood and appreciated that the transistors of the circuits shown in FIGS. 1, 2 and 5 may be NPN transistors or PNP transistors. When NPN transistors are employed, the entire system will be redesigned such that the p-type transistors are replaced with n-type transistors, and vice-versa. Additionally, it is understood and appreciated that the design may be further arranged to operate using other field effect transistor types including, but not limited to JFET transistors, GaAsFET transistors, and the like.

The above specification, examples and data provide a complete description of the manufacture and use of the composition of the invention. Since many embodiments of the invention can be made without departing from the spirit and scope of the invention, the invention resides in the claims hereinafter appended.

I claim:

1. An apparatus for providing improved power-on speed and power supply rejection ratio (PSRR) characteristics for a low drop-out (LDO) voltage regulator, comprising:

a first capacitive circuit that is coupled to an output of the low drop-out (IDO) voltage regulator;

a second capacitive circuit that is selectively coupled to a power supply and is arranged to store charge while the low drop-out (LDO) voltage regulator is deactivated; and a first switch circuit that is coupled between the first capacitive circuit and the second capacitive circuit such that a portion of the charge associated with the second capacitive circuit is transferred to the first capacitive circuit when the low drop-out (LDO) voltage regulator is activated.

2. The apparatus of claim 1, further comprising a second switch circuit that is coupled between the second capacitive circuit and a power supply.

3. The apparatus of claim 2, further comprising a resistor that is coupled between the power supply and the second switch circuit.

4. The apparatus of claim 2, wherein the first switch circuit is open and the second switch circuit is closed while the low drop-out (LDO) voltage regulator is deactivated.

5. The apparatus of claim 2, where the first switch circuit is closed and the second switch circuit is open when the low drop-out (LDO) voltage regulator is activated.

6. The apparatus of claim 1, wherein the first capacitance circuit, the second capacitance circuit, and the first switch circuit are integrated in the low drop-out (LDO) voltage regulator.

7. An apparatus, comprising:

a low drop-out (LDO) voltage regulator that is configured to provide an output voltage to an output when activated and to not provide the output voltage when deactivated;

a first capacitive circuit that is coupled to the output of the low drop-out (LDO) voltage regulator; and a second capacitive circuit that is selectively coupled to a power supply during a first cycle and selectively coupled to the first capacitive circuit during a second cycle.

8. The apparatus of claim 7, wherein the first cycle corresponds to when the low drop-out (LDO) voltage regulator is deactivated, and the second cycle corresponds to when the low drop-out (LDO) voltage regulator is activated.

9. The apparatus of claim 7, wherein a first switch circuit is coupled between the second capacitive circuit and the power supply and a second switch circuit is coupled between the first capacitive circuit and the second capacitive circuit.

10. The apparatus of claim 9, wherein the first switch circuit is closed and the second switch circuit is open during the first cycle.

11. The apparatus of claim 9, wherein the first switch circuit is open and the second switch circuit is closed during the second cycle.

12. The apparatus of claim 9, further comprising a first resistor that is coupled between the first switch circuit and the power supply such that current is provided to the second capacitive circuit across the first resistor when the first switch circuit is closed.

13. The apparatus of claim 9, wherein the first switch circuit is responsive to a first control signal and the second switch circuit is responsive to a second control signal, wherein the first control signal and the second control signal are non-overlapping.

14. The apparatus of claim 7, wherein the first capacitive circuit is selected to correspond to 0.1 times the capacitive value of the second capacitive circuit.

15. A method for improving power-on speed and power supply rejection ratio (PSRR) characteristics for a low drop-out (LDO) voltage regulator, comprising:

coupling a first capacitive circuit to an output of the low drop-out (LDO) voltage regulator;

charging a second capacitive circuit when the low drop-out (LDO) voltage regulator is deactivated; and transferring a portion of the charge from the second capacitive circuit to the first capacitive circuit when the low drop-out (LDO) voltage regulator is activated, wherein the output of the low drop-out (LDO) voltage regulator is initialized by the charge transfer such that the low drop-out (LDO) voltage regulator has a decreased power-on transient and an improved power supply rejection ratio (PSRR).

16. The method of claim 15, further comprising:

closing a first switch circuit coupled between a power supply and the second capacitive circuit when the low drop-out (LDO) voltage regulator is deactivated; and opening a second switch circuit coupled between the first capacitive circuit and the second capacitive circuit when the low drop-out (LDO) voltage regulator is activated.

17. The method of claim 15, further comprising:

opening a first switch circuit coupled between a power supply and the second capacitive circuit when the low drop-out (LDO) voltage regulator is activated; and closing a second switch circuit coupled between the first capacitive circuit and the second capacitive circuit when the low drop-out (LDO) voltage regulator is deactivated.

18. The method of claim 15, further comprising selecting a ratio between the first capacitive circuit and the second capacitive circuit such that the amount of charge transferred to the first capacitive circuit is comparable to the power supply.

* * * * *

UNITED STATES PATENT AND TRADEMARK OFFICE

CERTIFICATE OF CORRECTION

PATENT NO. : 6,759,836 B1
DATED : July 6, 2004
INVENTOR(S) : Robert G. Black, Jr.

It is certified that error appears in the above-identified patent and that said Letters Patent is hereby corrected as shown below:

Title page,
Item [57], ABSTRACT,
Line 11, please change "charges" to -- charge --.

Signed and Sealed this

Twenty-first day of December, 2004

JON W. DUDAS
*Director of the United States Patent and Trademark Office*